US005442903A

United States Patent [19]

Lagarrigue

[11] Patent Number: 5,442,903

[45] Date of Patent: Aug. 22, 1995

[54] THERMOSET TWIST COMPOSED OF SYNTHETIC MONOFILAMENTS

[75] Inventor: Gérard Lagarrigue, Saint-Juery, France

[73] Assignee: Rhone-Poulenc Fibres, Lyons, France

[21] Appl. No.: 156,351

[22] Filed: Nov. 23, 1993

Related U.S. Application Data

[63] Continuation of Ser. No. 68,585, May 28, 1993, abandoned, which is a continuation of Ser. No. 833,715, Feb. 11, 1992, abandoned.

[30] Foreign Application Priority Data

Feb. 21, 1991 [FR] France ..... 91 02309

[51] Int. Cl.[6] ..... D02G 3/48

[52] U.S. Cl. ..... 57/236; 57/282; 57/902

[58] Field of Search ..... 57/236, 241, 242, 200, 57/282, 902

[56] References Cited

U.S. PATENT DOCUMENTS

| | | | |
|---|---|---|---|
| 2,273,200 | 2/1942 | Hoff | 57/236 X |
| 2,509,741 | 5/1950 | Miles . | |
| 3,419,060 | 12/1968 | Goy | 57/236 X |
| 3,632,646 | 1/1972 | Hageman et al. . | |
| 3,877,214 | 4/1975 | Van der Werf . | |
| 3,889,457 | 6/1975 | Kenyon et al. | 57/236 |
| 4,987,939 | 1/1991 | Yamada et al. | 57/902 X |
| 5,024,877 | 6/1991 | McCalbugh, Jr. et al. | 428/282 |

FOREIGN PATENT DOCUMENTS

| | | |
|---|---|---|
| 2057698 | 5/1971 | France . |
| 2155219 | 5/1973 | France . |
| 2051165 | 1/1981 | United Kingdom . |

*Primary Examiner*—Joseph J. Hail, III
*Attorney, Agent, or Firm*—Sherman and Shalloway

[57] ABSTRACT

Monofilament twist for applications, such as, for example, use as a reinforcement in tires, for paper-machine junction felts, as a canopy support and for knitting, braiding or other textile operations, consisting of at least two monofilaments of synthetic material of a grist at least equal to 20 tex, assembled, twisted and thermoset and virtually free of untwisting stress. The synthetic material is preferably based on polyamide or polyester. Process for the production of twists.

23 Claims, 1 Drawing Sheet

THERMOSET TWIST COMPOSED OF SYNTHETIC MONOFILAMENTS

This application is a continuation of application Ser. No. 08/068,585, filed May 28, 1992, now abandoned; which is a continuation of application Ser. No. 07/833,715, filed Feb. 11, 1992, now abandoned.

The present invention relates to a thermoset twist produced from monofilaments of synthetic material and to a process for producing the said twist.

A monofilament is, by definition, a continuous thread consisting of a single filament. It is employed, generally as it is, for example as gut or as bristles, in textile applications, such as the weaving or knitting of industrial fabrics or knits, in the papermaking industry, for example as loops for paper-machine junction felt, etc. It can also be employed in the form of cabled yarns in textile applications, such as the weaving or knitting of industrial fabrics or knits (for example, based on wet-felt needling), in elastomer reinforcement applications (for example, tire reinforcement), etc.

A cable is defined as the product resulting from the assembling and twisting of two or more twists of monofilaments; a twist being defined as the product, hitherto an intermediate product, resulting from the assembling and twisting of two or more monofilaments. In some cases, the intermediate twist can consist of a single filament to which a twisting has been applied.

The production of a monofilament cable requires a plurality of successive operations, particularly the assembling and twisting of the monofilaments in one direction (for example, S) and then the assembling and twisting of a plurality of twists in the opposite direction (in this particular instance, Z), thereby providing the cabled yarn. The oppositely directed twistings for the twist and the cabled yarn are intended to generate a mechanical blocking of the cabled yarn by the opposition and balancing of the untwisting forces. This mechanical blocking nevertheless leaves the cabled yarn with some sinew; a kinking of the cabled yarn in the free state occurs, and this is detrimental to its conversion into, for example, fabrics or knits. To overcome this sinew, it is sometimes necessary to apply high tensions, as a result of which the elastic limits of the material are exceeded, at the risk that it will be damaged.

From an economic point of view, since the production of these cabled yarns is carried out in a plurality of operations, it requires much more added value and an appreciable investment in equipment. On the other hand, where coated cabled yarns are concerned, such as those which are employed for tire and papermaking applications and coated fabrics and which are coated with a substance based on resorcinol, formol, silicone or other rapid-adhesion products for the purpose of assisting the adhesion, flow or any other adhesion, the coating operation at the present time necessitates a rerun of the cabled yarns through additional installations, thus resulting in an increase in investment.

To reduce the number of operations necessary for producing cabled yarns, it would be possible to replace them by twists and thus have a single twisting stage. In this case, however, there is no possibility of utilising the opposing effect of the oppositely directed twistings in order to obtain a product which is relatively inert or which at least has very little sinew. In this case, it would be necessary to apply an overtwist so as to work beyond the elastic limits, but there is then a great risk that the material would be damaged, and therefore this method cannot be adopted.

Figure 1:
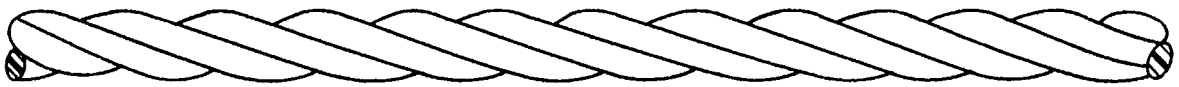
FIG. 1 is a schematic illustration of a monofilament twist according to the present invention having the monofilaments twisted in a single direction.

The object of the present invention is to afford a solution to the abovementioned problems.

It relates to a monofilament twist for applications, such as industrial textile applications, elastomer reinforcements, papermaking industry and the like, characterised in that it consists of at least two monofilaments of synthetic material of a grist higher than or equal to 20 tex, assembled, twisted and thermoset, and in that it is virtually free of untwisting stress.

The synthetic materials which are suitable are all those conventionally used for the production of monofilaments and particularly polyesters and polyamides in the form of homopolymers, of copolymers or of mixtures of polymers, as appropriate.

The number of monofilaments is not limited; it is a function of the characteristics desired for the product produced. However, in general, this number is between two and nine.

The grist of each monofilament depends on the use for which the twist is intended. However, the grist is preferably between 20 and 500 tex.

The twist torsion assumes the values which are customary in this type of operation and which are to a large extent a function of the unit grist and of the number of unit monofilaments.

The twist is thermoset under the conditions defined in the production process claimed below.

Being free of internal stresses, the twist obtained, which has undergone changes of orientation during the thermosetting, will have no untwisting or separation of the filaments relative to one another when it is subjected to shearing or pressure.

The present invention also relates to a process for producing the abovementioned twist. It is a process for producing a monofilament twist, thermoset and virtually free of untwisting stress, characterised by the following stages:

- assembling of at least two monofilaments of synthetic material oriented and with little or no relief,
- twisting of the assembly to the desired value, with the application of a tensile stress higher than the elastic limit stress,
- thermosetting of the twisting kept blocked and, simultaneously, relief of the twist, the setting temperature being higher than the thermal transition of the material,
- reception of the set and relieved twist on any suitable support.

The initial monofilaments are produced by a conventional process of extrusion, drawing in a plurality of phases and relief; however, the relief rate is lower than that normally adopted. Thus, when the monofilaments are based on polyamide, the relief rate is advantageously between 0% and 6%, instead of 0% to 12% which are the values usually adopted. The dynamometric characteristics are those customary for this type of product and depend on the material. For polyamide 66, the breaking elongation of the initial monofilaments is advantageously between 10% and 20%. In view of the relief rate, the material is in the moderately relieved state, with the macromolecules slightly regrouped.

Two or more filaments are assembled continuously in a known way; discontinuously, the necessary precautions will have to be taken in order to obtain an assembly with a uniform thread tension calculated so as not to generate any winding or twisting fault.

The twisting will be carried out from these assembled monofilaments in a single operation on a suitable machine.

For the twisting stage, the assembly is placed, for example, in a single- or double-twist can, where it acquires the desired twist.

During this operation, the assembly is subjected to a tensile stress higher than the elastic limit stress, and therefore it experiences a slight deformation akin to an additional drawing, but with the molecules oriented in the direction of the twist. At this stage, the product remains very sinewy because it is subjected to an internal untwisting stress.

To prevent the untwisting, the twisting is blocked at the exit of the twisting zone and during the entire thermosetting stage which takes place in a setting zone following the twisting zone. The setting zone comprises a thermal-treatment furnace, and it is advantageously delimited by two capstans: an entry capstan (also marking the exit of the twisting zone) taking up the twist at a constant speed, whilst at the same time keeping the twisting blocked, and an exit capstan rotating at a speed lower than the entry speed, thereby allowing the relief of the twist. The thermal treatment at a temperature higher than the thermal transition of the material, with the possibility of relief, will set the said material by the regrouping of the molecular chains, with the internal orientation acquired during the twisting giving the product a stability which eliminates most or even all of its sinew.

The twist is received, for example, on a parallel-wound bobbin.

According to one version of the invention, an additional stage of surface treatment, for example coating, is incorporated between the twisting and the setting. For this, it is necessary to keep the twist blocked during this operation, and this can be achieved by means of an additional capstan.

The process is carried out at the conventional cabling speeds, that is to say generally between approximately 20 and 50 m/min.

The twist according to the invention, capable of replacing cables and, in some cases, monofilaments used in isolation, has many advantages:

- mechanical properties equivalent to or even higher than those of a cable of the same grist,
- greater geometrical uniformity, particularly the absence of knotty effect found on a cable,
- higher flexibility than a monofilament or than a cable of the same grist,
- less or even no kinking, more inert product.

The process is advantageous in economic terms because it makes it possible to omit a twisting stage. Moreover, if desired, it allows the continuous incorporation of an additional stage, such as coating, which has hitherto been carried out discontinuously and has required a rerun of the cable.

The twist according to the present invention has many uses, and in general terms it is employed for any industrial textile application requiring the presence of a cable or twist of a grist higher than 20 rex, for example:

- industrial fabric requiring dimensional stability, the twist being coated or not,
- tire applications, with a coated twist,
- papermaking formation cloth by the substitution of monofilaments,
- canopy support,
- knitting, braiding or other textile operations,
- paper machine junction felts. The thermoset twist of the invention is more convenient for the application because the location of the paper machine junction felt around the junction rod is improved due to its flexibility similar to cable and to its regular section like to monofilament.

However, the invention will be better understood from the following examples given as a non-limiting illustration.

EXAMPLE 1

The reference product, a current cabled yarn, which the twist according to the invention is to replace, is produced from shrunk monofilaments of polyamide 66 by the mode of operation described below.

A polyamide 66 of a melting point of 256° C. and a viscosity index (IV) of 126, measured in conformity with the international standard ISO 307-1977, is extruded under the following conditions:

| | |
|---|---|
| die | 56 holes |
| capillary diameter | 0.80 mm |
| total flow rate | 40 kg/h |
| extrusion temperature | 280° C. |

After extrusion, the monofilaments are cooled in water at 35° C. and then undergo a series of three hot-drawing phases:

1st drawing:

drawing rate: 3.6 drawing temperature (by passage through a water bath): 95° C.

2nd drawing:

cumulative drawing rate: 4.5 drawing temperature (by passage through a hot furnace): 160° C.

After drawing, the monofilaments are subjected to relief and to thermosetting, relief rate 12%, setting temperature 215° C. (passage through a hot-air furnace). The monofilaments are finally wound, winding speed: 180 m/min, weight of windings: 2 kg.

The monofilaments obtained have the following characteristics:

| | |
|---|---|
| grist | 60.5 tex |
| mean diameter | 0.26 mm |
| mean linear tearing strength | 3.0 daN |
| (mean) breaking elongation | 28% |
| (mean) shrinkage in boiling water | 2.0% |
| mean tenacity | 50 CN/tex |

Three of these monofilaments are cabled to form a product of a diameter of approximately 0.46 mm, this being a cabling of 1 filament×3 filaments, each unit filament having undergone a primary twisting of Z240 turns/m, the three filaments then being assembled and the assembly cabled by means of an opposite twisting of S250 turns/m. A twist according to this construction is shown in FIG. 1. The cable obtained has the following characteristics:

| | |
|---|---|
| grist | 195 tex |
| tearing strength | 7.4 daN |
| tenacity | 38 CN/tex |
| shrinkage in boiling water | 1.6% |
| kinking | 10 turns/m |

The kinking is measured by the method described in French Standard G07 314, and it corresponds to the number of loops formed after 1 meter of cable or twist has been unwound and the ends joined.

This cabled yarn can be employed in applications, such as a base for papermaking felts and, in some cases, as weft on a loom to form the felt junction loop, this loop subsequently being arranged in the running direction on a paper machine.

A twist according to the invention is then produced by way of comparison.

The monofilaments are produced by the same process as the reference product with the same parameters, excepting the relief rate which is 6%, instead of 12%, and in this case the assembly in three.

The monofilaments have the following characteristics:

| | |
|---|---|
| grist | 60.5 tex |
| mean diameter | 0.26 mm |
| mean linear tearing strength | 3..0 daN |
| (mean) breaking elongation | 21% |
| (mean) shrinkage in boiling water | 8.0% |
| mean tenacity | 50 CN/tex |

From the three-filament yarn, as above, a twist according to the invention is produced by the process according to the invention.

A modified twisting machine is employed for carrying out the process, and it comprises particularly a thermosetting furnace, a first take-up capstan located upstream of the furnace (exit of the twisting zone) and a second capstan located downstream of the furnace (exit of the setting zone).

The three-filament bobbin is arranged in the twisting can of the machine where the assembly receives a twisting of S240. The twisting is carried out with the application of a tension of 400 CN, that is to say a stress of 2.2 CN/tex higher than the elastic limit stress. Continuously, with the twisting kept blocked by the capstans, the twist is subjected to a thermosetting by passage through the furnace at a temperature of 200° C., which is higher than the thermal transition of the material, with a relief rate of 8% being applied. The speed of the upstream capstan is 21.6 m/min and that of the downstream capstan is 20 m/min, that is to say identical to the production speed of the reference cabled yarn, with the result that there is no loss in productivity.

The twist is received on a parallel-wound bobbin, weight of the winding 2 kg. The twist has the following characteristics:

| | |
|---|---|
| grist | 200 tex |
| tearing strength | 8.1 daN |
| tenacity | 40.5 CN/tex |
| shrinkage in boiling water | 1.6% |
| kinking | 1 turn/m |

It may be noted that the dynamometric characteristics of the twist are virtually identical to (slightly higher than) those of the reference cabled yarn. In contrast, its sinew is clearly reduced: a kinking of 1 turn/meter instead of 10 turns/meter, this representing a considerable improvement. The twist advantageously replaces the reference cabled yarn in the applications mentioned, and moreover its production process, shorter because there is no stage of applying the primary twisting, affords an appreciable economic saving.

EXAMPLE 2

The twist according to Example 1 is used for making junction loops on paper-machine junction felt in the press section. This junction is obtained by means of a loop at each end of the felt, assisting its fitting when it is being changed, and for this purpose a ring is introduced between the loops, thus tying the felt.

Conventionally, these loops are produced from monofilament. However, the monofilament is a rigid product which tends to undergo an inclination when the loop is being shaped. These cables are far too sinewy products and present many problems in this application.

The thermoset twist according to the invention replaces a monofilament of a grist of 200 tex, and it affords the characteristics of flexibility and of longitudinal sectional uniformity.

This sectional uniformity will be conducive to the characteristics sought after in felts, namely dryness and compressibility. The fact that this twist has a non-round cross-section assists the blocking of the stitches during the making of the base.

EXAMPLE 3

This relates to the production of a coated twist which can be employed in applications, such as dirt-repelling industrial fabric.

It is produced under the same conditions as those described in Example 1, but with a coating stage being introduced between the twisting and the thermosetting. The coating equipment consists of a doctor roller.

The product to be applied is a polymerisable silicone of rapid polymerisation which takes the form of a liquid.

The thermal-treatment furnace is used both for the thermosetting of the twist (setting of the twisting) and for the polymerisation of the coating.

The speed of the process is between 20 and 50 m/min.

I claim:

1. A monofilament twist suitable for use in industrial textile applications, elastomer reinforcements, and the paper making industry, wherein the twist consists of untwisted monofilaments of synthetic material of a grist of at least 20 tex, said twisted assembly being twisted in only a single direction, and having been thermoset, and wherein the twist is virtually free of untwisting stress.

2. The twist according to claim 1 wherein said twist is twisted less than two turns per meter when said twist is untwisted with its ends joined.

3. The twist according to claim 2 wherein the synthetic material is polyester.

4. The twist according to claim 2 wherein the synthetic material is polyamide.

5. Twist according to claim 1, characterised in that the synthetic material comprising polyester.

6. The twist according to claim 5 wherein the synthetic material is polyamide.

7. The twist according to claim 6 wherein the polyamide comprises polyamide 66.

8. The twist according to claim 6 wherein the polyamide comprises copolyamide 66/6.

9. Twist according to claim 1, characterised in that the synthetic material comprising polyamide.

10. The twist according to claim 9 wherein said polyamide is polyamide 66.

11. The twist according to claim 9 wherein said polyamide is copolyamide 66/6.

12. The twist according to claim 1 wherein the twist is twisted up to one turn per meter when said twist is untwisted with its ends joined.

13. The twist according to claim 1 which comprises from 2 to 9 of said monofilaments.

14. The twist according to claim 1 wherein said twist further comprises a surface coating.

15. The twist according to claim 14 wherein said surface coating comprises a polymerizable silicone.

16. A process for producing a monofilament twist which is thermoset and virtually free of untwisting stress and consisting of untwisted monofilaments of synthetic material of a grist of at least 20 tax, comprising the following stages:

assembling at least two monofilaments of synthetic material of a grist of at least 20 tax oriented and with little or no relief, twisting the assembly in only a single direction to the desired value, while applying a tensile stress higher than the elastic limit stress, setting the twist by blocking the twist and thermosetting the blocked twist and, simultaneously, relieving the twist, the thermosetting temperature being higher than the thermal transition of the material, and receiving the set and relieved twist on a support.

17. The process according to claim 16, wherein the initial monofilaments comprise polyamide and are obtained by extrusion, drawing and relief with a relief rate of between 2% and 8%.

18. The process according to claim 16 wherein the twisting and thermosetting operations are carried out continuously by passage through consecutive twisting and setting zones.

19. The process according to claim 18 wherein the blocking of the twisting during the setting stage comprises passing the twist through two take-up capstans located respectively at the entry and at the exit of the setting zone.

20. The process according to claim 16, further comprising surface treating the twist between the twisting and setting stages.

21. The process according to claim 20, wherein the surface treating comprises applying a coating to the twist.

22. The process according to claim 16 wherein the twist is twisted less than two turns per meter when said twist is untwisted with its ends joined.

23. The process according to claim 16 wherein the twist comprises polyester.

* * * * *